US005188289A

United States Patent [19]

Pesho

[11] Patent Number: 5,188,289

[45] Date of Patent: Feb. 23, 1993

[54] DRIPLESS, SPLASHLESS NOZZLE

[75] Inventor: Stephen W. Pesho, Dalton, Ohio

[73] Assignee: Euclid Spiral Paper Tube Co., Apple Creek, Ohio

[21] Appl. No.: 718,190

[22] Filed: Jun. 20, 1991

[51] Int. Cl.[5] ..... B05B 17/00

[52] U.S. Cl. ..... 239/1; 239/499; 222/571

[58] Field of Search ..... 239/499, 504, 518, 520, 239/462, DIG. 23, 1; 222/571, 214

[56] References Cited

U.S. PATENT DOCUMENTS

| | | | |
|---|---|---|---|
| 168,201 | 9/1875 | Wharton | 239/499 |
| 2,985,385 | 5/1961 | Bowers et al. | 239/499 |
| 3,011,684 | 12/1961 | Corneil | 222/214 |
| 3,344,732 | 10/1967 | Kleydorff et al. | 239/499 |
| 4,271,988 | 6/1981 | Clausen | 222/214 |

FOREIGN PATENT DOCUMENTS

| | | | |
|---|---|---|---|
| 2845423 | 4/1979 | Fed. Rep. of Germany | 222/214 |
| 1441642 | 5/1966 | France | 239/499 |

*Primary Examiner*—Andres Kashnikow
*Assistant Examiner*—Karen B. Merritt
*Attorney, Agent, or Firm*—Oldham, Oldham & Wilson Co.

[57] ABSTRACT

A nozzle assembly for dripless, splashless dispensing of liquids of various viscosities is comprised of three elements: a tubing terminator, a nozzle body and a nozzle head. The tubing terminator is adapted at a first end to accept fluid flow from a compressible tube into a central bore, which does not extend all of the way to the second end, but ends with at least one radial bore. When the tubing terminator is inserted into the nozzle body and fluid flow is initiated, the fluid leaving the terminator impinges an intermediate bore portion having walls angling away from the longitudinal axis of the nozzle body. This impingement serves to swirl the fluid and minimize dripping and splashing. A nozzle head, which covers the flow chamber into which the intermediate bore portion of the nozzle body opens, has a wire mesh screen covering the opening out of which the fluid is dispensed.

1 Claim, 4 Drawing Sheets

DRIPLESS, SPLASHLESS NOZZLE

The present invention relates to a nozzle for dispensing liquids of various viscosities from a peristaltic pump. More particularly, the present invention relates to an easily cleaned nozzle wherein a plurality of holes impinge the liquid internally of the nozzle against a splash plate to eliminate external splashing or dripping from the nozzle. Even more particularly, the present invention relates to a nozzle for precisely dispensing liquids of a wide range of viscosities from a peristaltic pump.

BACKGROUND ART

Peristaltic pumps are well known and widely used in applications where contamination of the fluid being transported is undesirable or unacceptable. In such a peristaltic pump, the fluid is contained in a compressible tube that is repeatedly compressed by rollers or the like, thereby expelling a precisely determinable portion of liquid from the end of the tube. Because of the ability to handle liquids in a precise and uncontaminated manner, such pumps have found wide application in the pharmaceutical and medical industries.

The compression of the tube in the peristaltic pump may be abrupt, so there is often an eruption or surge of fluid from the pump, which can result in dripping and splashing of the liquid. In circumstances where precise delivery of liquid is required, for example, in dispensing liquid medications into uni-dose containers, such dripping and splashing is intolerable. The particular applications of the peristaltic pump that require precise and uncontaminated delivery of liquid also dictate that any reusable parts, particularly nozzles and the like, used in conjunction with such fluids must be easily disassembled for cleaning and/or sterilization purposes. The same applications dictate that the surfaces be generally "clean", that is, that they are generally smooth and contain few niches or crannies that can deter easy cleaning.

SUMMARY OF THE INVENTION

It is, therefore, a first object of the invention to provide a nozzle for a fluid, particularly in a compressible tube, and even more particularly where the fluid is pumped by a peristaltic pump. It is a further object to provide a nozzle for such a fluid that minimizes or eliminates splashing or dripping of the fluid emerging from the tube.

It is a further object of the invention to provide a nozzle that is easily disassembled for cleaning and/or sterilization.

These and further objects of the invention are achieved by a nozzle assembly for a tubing, said assembly comprising a tubing terminator, a nozzle body and a nozzle head. In such a nozzle assembly, the generally cylindrical tubing terminator has first and second ends with a central bore from the first end terminating short of the second end, with at least one radial orifice bored through the terminator proximate to the second end, each orifice communicated to said central bore. The first end is provided with means for frictionally engaging the tubing, and the second end is provided with means for engaging the nozzle body. The nozzle body also has first and second ends and a central bore, but the central bore goes entirely through the nozzle body along the longitudinal axis. The central bore has first and second portions of differing constant diameters, the first portion having an inner radius slightly larger than the outer diameter of the tubing terminator and the second portion having an inner diameter larger than the first portion. The first and second portions are communicated by a third or intermediate portion having an inner diameter which increases smoothly from the diameter of the first portion to the diameter of the second portion. The nozzle body is provided at its first end with means for engaging the tubing terminator such that each of the radial orifices is juxtaposed with the third portion of the central bore of the nozzle body. The nozzle head has first and second ends with a central bore therethrough, the first end provided with means for attaching the nozzle head to the second end of the nozzle body and the central bore at said second end provided with a screen means to generally hold the liquid in place from dripping.

BRIEF DESCRIPTION OF THE DRAWINGS

The accompanying drawings, in which like numbers indicate like parts, are as follows.

DETAILED DESCRIPTION OF THE DRAWINGS

Figure 7:
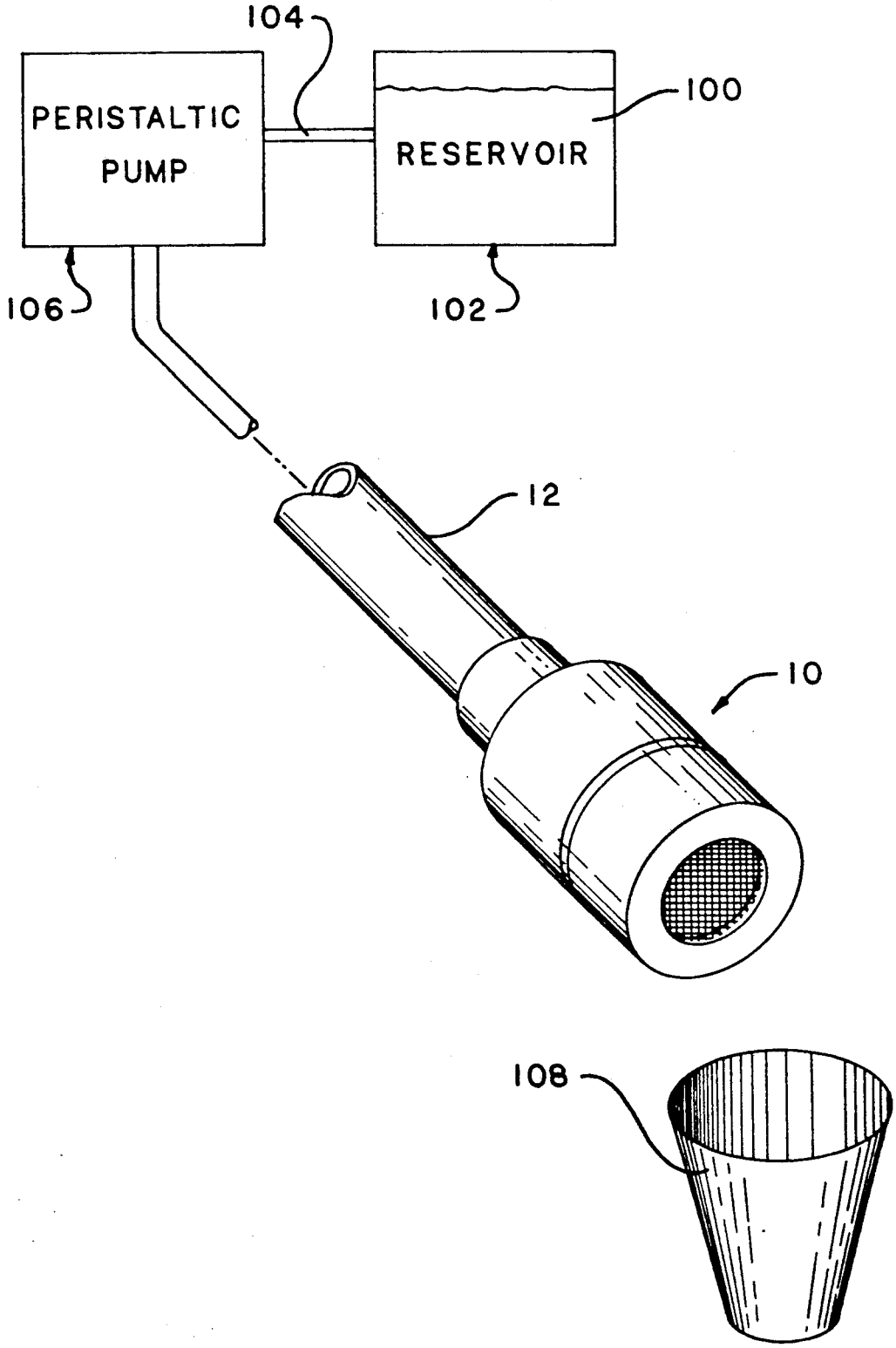
FIG. 7 is a schematic view of the use of the present invention in dispensing an aliquot of fluid into a container.

Applications of the peristaltic pump 106, as shown schematically in FIG. 7, are well known. The most common application of such a pump 106 are situations where contamination of the fluid being pumped is unacceptable, precise measurement and delivery of the fluid is necessary, or both. Since the action of the pump requires a compressible tubing be used to contain the fluid, such as the type of tubing commercially available from Norton Company of Worcester, Mass., under the tradename "TYGON", it is customary to utilize such tubing as the conduit leading up to the peristaltic pump and also the conduit leading away from the peristaltic pump to the point of dispensing. Use of the open, unobstructed tubing end as a dispensing nozzle is undesirable, however, because the abrupt flow of the peristaltic pump may result in dripping, splashing, or other uneven eruption of the liquid from the tubing end. Also, backflow of the liquid due to the action of the peristaltic pump can permit some contamination of the fluid if the unobstructed tubing is used as a nozzle. Although one method of eliminating the backflow or dripping problem is to provide the tubing end with at least one rigid orifice of a reduced diameter, the increased pressure at that point may result in increasing the splash problem of the nozzle. These problems may be greatly increased when liquids of varying viscosities are used.

Figure 1:
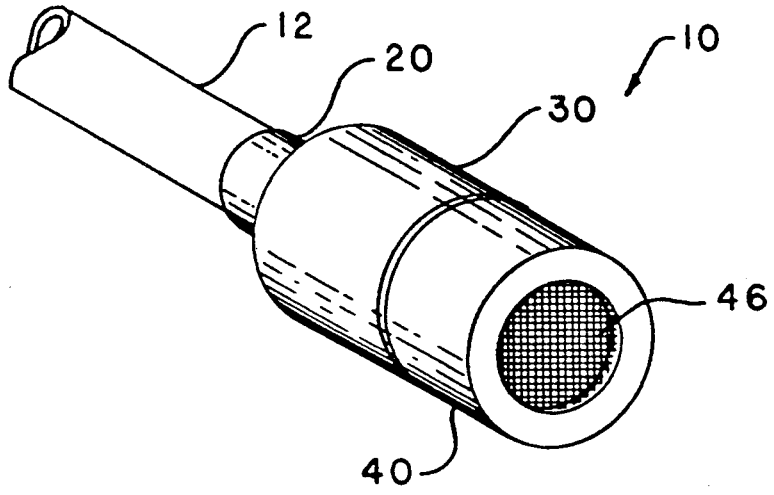
FIG. 1 is an assembled perspective view showing the nozzle assembly of the present invention.
Figure 2:
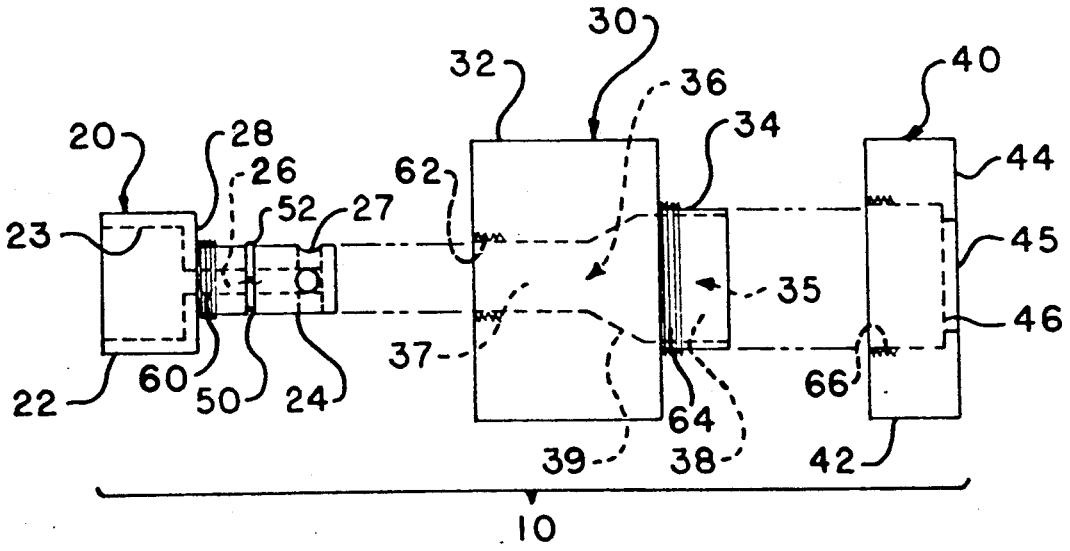
FIG. 2 is an exploded view of the nozzle assembly.

As shown in an assembled state in FIG. 1 and in an exploded view in FIG. 2, the nozzle assembly 10 of the present invention comprises three elements, each capable of being quickly and easily assembled and disassembled for cleaning, replacement and other purposes. Of these, the first element is a tubing terminator 20 having a first end 22 and a second end 24. The tubing terminator 20 is generally cylindrical and contains a central internal bore 26, originating at the first end 22 but terminating short of the second end 24. The first end 22 is sized so that the internal portion 23 thereof frictionally engages and retains the end of a compressible tubing 12, the tubing end acting as the male portion of the junction and the internal portion 23 of first end 22 acting as the female portion. The tubing terminator 20 preferably has a larger external diameter at the first end 22 of the terminator than it does along the remainder or second end 24 of the terminator. This abrupt change in external diameter (shown as 28 in FIG. 2) is useful in properly seating the tubing terminator 20 against the second portion of the nozzle assembly 10, that being the nozzle body 30. Preferably, the inner diameter of the second portion of the central bore 26 is approximately the same as the inner diameter of the tubing used with the device.

Figure 4A:
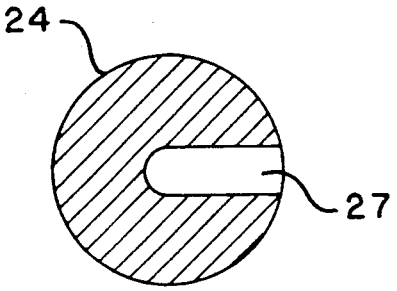
FIGS. 4*a–c* are sections taken along Line 4—4 in FIG. 3, showing different embodiments of numbers of orifices 27.
Figure 4B:
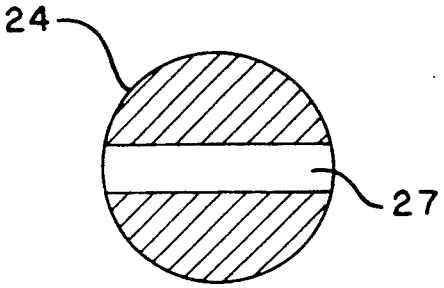
Figure 4C:
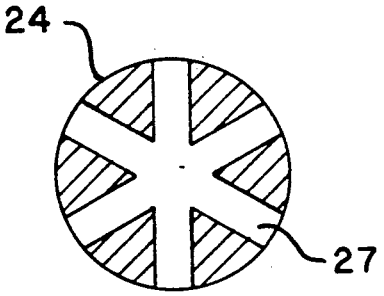

At the second end 24 of the tubing terminator 20, there is at least one hole 27 drilled in a radial direction so that the radial hole 27 is communicated with substantially the end of the central bore 26. It will be easily recognized that the presence of such a radial hole or holes 27 will cause an abrupt 90 degree change of flow direction in the fluid from the longitudinal to the radial direction. As shown in the FIGS. 4*a–c*, the preferred embodiment will contain at least two and even more preferably four such radial holes 27, although at least only one such hole is required and up to six or so holes will also be effective. In order to fit more than six such holes 27 around the circumference of the second end 24 would require making the diameters of the individual holes smaller, thereby possibly causing clogging of the holes, particularly when the fluid being dispensed is more viscous. To maintain structural integrity of the tubing terminator 20, it would be standard practice to arrange the radial holes 27 symmetrically in an equiangular arrangement around the circumference of the second end 24, although this is a design choice that may be varied depending upon the particular application.

Figure 5:
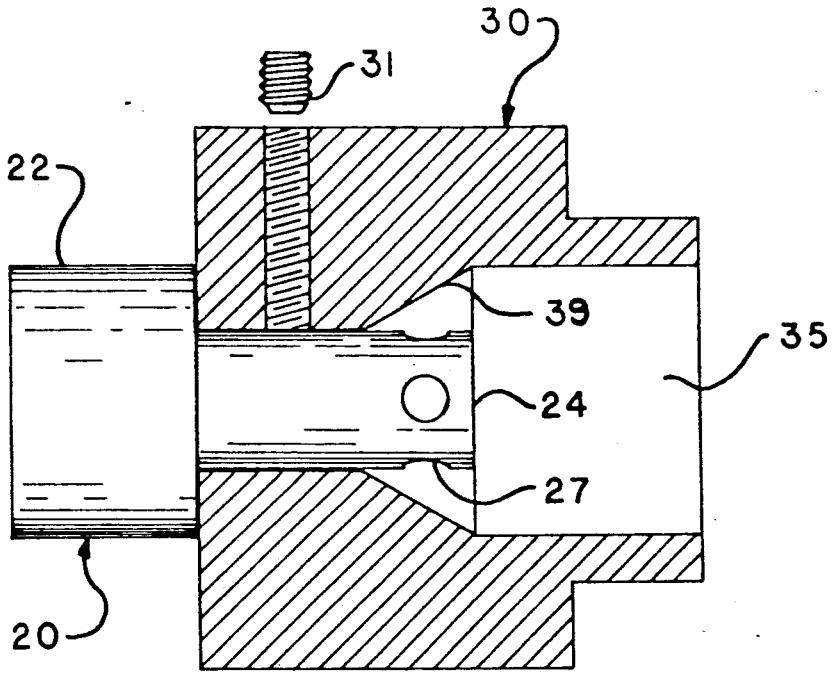
FIG. 5 is a cross-sectional view of the nozzle body shown in operative engagement with a tubing terminator of the present invention.

The second element of the present invention is the nozzle body 30, which is shown in FIGS 1, 2 and 5. The nozzle body is generally cylindrical and has a constant outer diameter along its length. Internally, however, the nozzle body will be seen to have a central bore 36 of changing diameter. A first portion 37 of the central bore 36, starting at the first end 32, has a fixed diameter sized to slidingly accept placement within it of the second end 24 of the tubing terminator 20, particularly as shown in FIG. 5. The connection of the second end of the tubing terminator 20 to the first end 32 of the nozzle body 30 is accomplished by known connection and retention means. Particularly, a first embodiment would involve radial placement of at least one set screw 31 through the first end 32 of the nozzle body 30 so that tightening of the screw 31 will cause the screw to bear upon and engage the tubing terminator 20 at its second end 24, as shown in FIG. 5. A second method, which is shown in FIG. 2, would be to use corresponding male and female threadings 60, 62 on the respective parts 24 and 32. The central bore 36 has a second section 38 of constant diameter at its second end 34 that is larger than the diameter of the first portion 37 of central bore 36. Between the first portion 37 of the central bore 36 and the second end of the central bore 36 is an intermediate portion 39 which has a smoothly increasing diameter starting at the diameter of the first portion 37 and increasing to the diameter of the second portion 38. Although a preferred embodiment of the invention as shown in FIG. 5 would have the volume of the internal bore 36 at the intermediate portion 39 essentially define a frustro-conical piece with the point of the cone extending imaginarily into the first section 37 of the central bore 36, it would also be possible to have the smooth increase of the inner diameter be accomplished with an arcuate surface, in which case the intermediate portion 39 would define a volume substantially similar to that of a truncated dome.

Regardless of whether the intermediate portion 39 of the central bore has the smooth increase of the diameter to occur in a linear or arcuate fashion, it is vital to the invention that the intermediate portion 39 be positioned such that when the tubing terminator 2 is attached to the nozzle body 30, the radial hole or holes 27 in the tubing terminator 20 are juxtaposed with the intermediate portion 39 of the central bore 36 of the nozzle body 30 so that the fluid expelling from the radial holes 27 is directed against the walls of the intermediate portion 39, thereby allowing that wall to act as a splash plate. This further change in the fluid flow will induce some swirling of the liquid and reduce the momentum of the fluid. As will be noted in FIG. 5, the walls of the intermediate portion 39 form an angle with the longitudinal axis of the nozzle body 30 and the central bore 36. This angle may vary between about 15° to about 75°, but the preferred angle is found to be from about 20° to about 40°. Of course, in the case where the increase in diameter of the intermediate portion is linear, the walls will increase linearly, that is, at a constant angle. In the more complex situation where an arcuate increase is utilized, the angularity may be measured by the tangent at any given point of the surface. In such a case, it is desirable to have the tangent to the surface at the point of impingement of the fluid from the radial holes to be in the range of 20° to 40°. The larger, or second portion 38, of the central bore effectively forms a flow chamber 35 for the fluid exiting from the radial holes 27.

Figure 6:
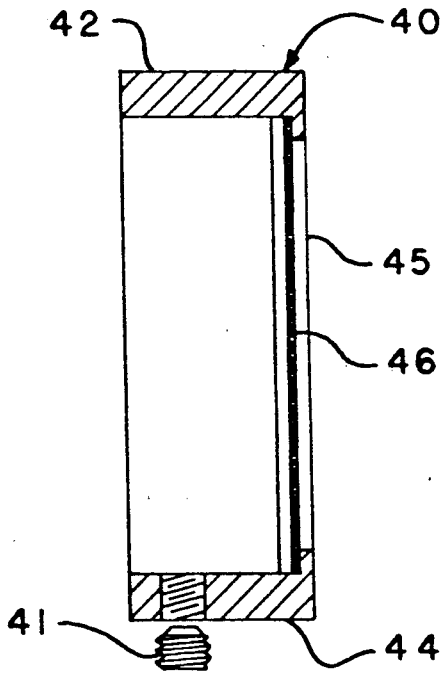
FIG. 6 is a cross-sectional view of the nozzle head of the present invention.

The third element is the nozzle head 40. As shown in FIG. 6, the preferred nozzle head 40 is a generally annular body having a first end 42 provided with means for fastening to the second end 34 of the nozzle body 30 so that the flow chamber 35 contained within the nozzle body 30 at its second end 34 is generally closed. At the second end 44 of the nozzle head 40, the exit orifice 45, which is only slightly smaller in diameter than the flow chamber itself, is covered by a mesh screen 46. This screen is intended to prevent contaminant particles from entering the flow chamber 35, as well as stopping dripping of the liquid. In order to be compatible with the nozzle assembly 10, it is desired that the screen 46 have a composition that is acceptable for handling food and pharmaceutical materials and be properly sized. In a particularly preferred embodiment, the screen means would comprise a disc of stainless steel screen of 40×40 mesh by 0.010" wire. In one embodiment, as particularly illustrated in FIG. 2, the means for fastening the nozzle head to the nozzle body 40 is conventional female threading 66 disposed on the inner surface of the first end 42 of the nozzle head 40 and corresponding to male threading 64 disposed on the outer surface of the second end 34 of the nozzle body 30. In another embodiment, as shown in FIG. 6, the means for fastening is a set screw 41 disposed in a threaded radial bore through the nozzle head 40 so that the set screw may be tightened and bear upon the outer surface of the second end 34 of the nozzle body 30.

In order to be compatible with the applications anticipated for the nozzle assembly 10, a preferred material of construction would be one that can be easily machined and that will be acceptable for use with Food and Drug Administration regulations for such applications. A particularly attractive material for such an application is 316 stainless steel. The present invention is not limited by the material of construction, however, and it will be recognized that many polymeric materials now available are very sturdy, machinable or moldable to close tolerances, and capable of being sterilized prior to use. An appropriate method of sterilization would be heating in an autoclave at 250° F. for a proper amount of time. A polymeric material that would be acceptable in this sort of service would be a polycarbonate, the exact selection of which would be obvious to one of skill in the art of selecting materials for compatibility with food and pharmaceutical uses. Such a polymeric material would also be useful in this application, and, in such a case, it may be possible to change some or all of the assembly parts as often as the connecting tubing is changed.

As shown somewhat schematically in FIG. 7, fluid 100 is placed in a liquid reservoir 102 connected by conduit means 104 with a peristaltic pump 106. Through an external power means (not illustrated) the peristaltic pump is activated, thereby pumping aliquots of the fluid 100 into a compressible conduit 12, such as the TYGON brand tubing sold by Norton Company. Such exit conduit 12 is connected as shown in FIG. 1 with the nozzle assembly 10 of the present invention. With each surge of the peristaltic pump, a single aliquot of the fluid 100 is pumped into the nozzle assembly 10, from which it may flow in a dripless, splashless fashion into a unidose container 108.

Figure 3:
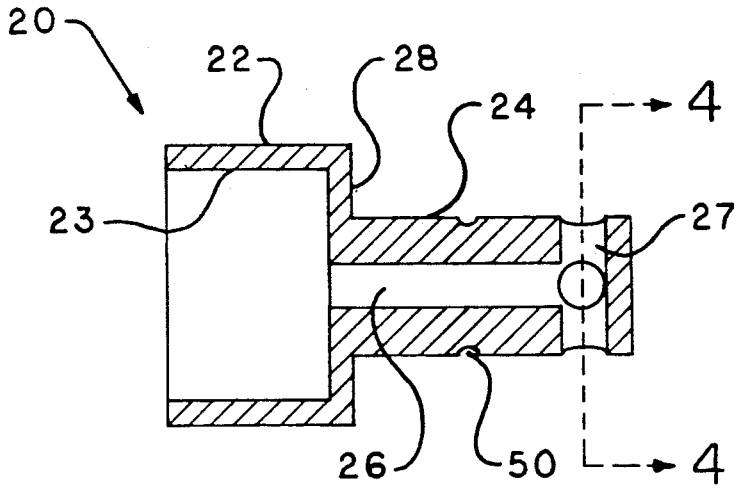
FIG. 3 is a cross-sectional view of the tubing terminator of the present invention.

In an even further embodiment of the present invention, shown in FIGS. 2 and 3, it may be desirable to place a circumferential groove 50 along the smaller diameter portion of the second end 24 so that an elastomeric "O" ring 52 may be positioned upon the circumferential groove, thereby assisting in the engagement of the second end 24 of the tubing terminator 20 into the first end 32 of nozzle body 30. The second purpose for such an "O" ring 52 is to prevent back flow of liquid from the flow chamber 35. The exact selection and placement of such an "O" ring will be familiar to one of skill in fluid transfer equipment.

While the fastening means shown in the accompanying drawings illustrate use of set screws and threading, these are not exhaustive of the varieties of fastening means within the ready use of one of skill in this art, and the use of such additional means in not precluded by the illustration of the means shown.

While in accordance with the patent statutes, the best mode and preferred embodiment of the invention have been described, it is to be understood that the invention is not limited thereto, but rather is to be measured by the scope and spirit of the appended claims.

What is claimed is:

1. A process for precisely dispensing an aliquot of a fluid, said process comprising:

a. placing in a reservoir an amount of said fluid comprising a plurality of said aliquots, said reservoir connected by tubing to a peristaltic pump, which is in turn connected by tubing to a nozzle assembly comprising: i) a generally cylindrical tubing terminator having first and second ends with a central bore from said first end terminating short of said second end, with at least one radial orifice bored therethrough proximate to the second end, said first end provided with means for engaging an end of said tubing; ii) a nozzle body having first and second ends and a central bore therethrough, said central bore having first and second portions of differing constant diameters, the first portion having an inner radius slightly larger than the outer diameter of said tubing terminator and the second portion having an inner diameter larger than said first portion, said first and second portions communicated by a third portion having an inner diameter which increases smoothly from the diameter of said first portion to the diameter of said second portion, said nozzle body provided at its first end with means for engaging said tubing terminator such that each said radial orifice is juxtaposed with the third portion of the central bore of the nozzle body; and iii) a nozzle head having first and second ends with a central bore therethrough, said first end provided with means for attaching said nozzle head to the second end of said nozzle body and the central bore at said second end provided with a screen means; and b. repeatedly energizing said peristaltic pump to dispense, in a splashless manner, a single aliquot of said fluid into a container positioned proximate to the second end of said nozzle head.

* * * * *